US005168836A

United States Patent [19]

Kraus

[11] Patent Number: 5,168,836

[45] Date of Patent: Dec. 8, 1992

[54] EMISSION CONTROL SYSTEM

[75] Inventor: Gregory Kraus, Long Beach, Calif.

[73] Assignee: Catalytic Solutions, Inc., Glendale, Calif.

[21] Appl. No.: 564,279

[22] Filed: Aug. 8, 1990

[51] Int. Cl.[5] ..... F02M 25/00; F02M 25/02

[52] U.S. Cl. ..... 123/25 F; 123/198 A; 261/91; 261/111; 261/115; 431/4

[58] Field of Search ..... 123/1 A, 3, 25 R, 25 A, 123/198 A, 25 B, 25 J, 25 K, 25 E, 25 F; 431/4; 261/91, 111, 115, 18.2

[56] References Cited

U.S. PATENT DOCUMENTS 3,880,124 4/1975 Stratton ..... 123/25 A
4,044,742 8/1977 Linder ..... 123/549
4,166,435 9/1979 Kiang ..... 123/25 B
4,306,520 12/1981 Slaton ..... 123/25 A
4,557,222 12/1985 Nelson ..... 123/25 B

*Primary Examiner*—Tony M. Argenbright
*Attorney, Agent, or Firm*—Ladas & Parry

[57] ABSTRACT

Disclosed herein is an emission control system including an air pretreatment system for enhancing the ability of air passing therethrough to absorb moisture, a humidification chamber having an inlet and an outlet, the inlet being attached to the air pretreatment system, the pretreated air passing from the air pretreatment system into the inlet and through the humidification chamber so that it is humidified at a consistently controllable rate in its passage through the humidification chamber to and out of the outlet.

32 Claims, 4 Drawing Sheets

EMISSION CONTROL SYSTEM

BACKGROUND OF THE INVENTION

The present invention designed to reduce emission levels, relates to catalytic emission control systems using a catalyst delivered into the combustion area via the incoming combustion air stream. Various techniques have been presented in the current literature about using airborne catalysts to improve fuel combustion. A recent invention of note is disclosed in U.S. Pat. No. 4,475,483 issued in the name of B. Robinson. In this patent, a system for delivering a catalyst into a fuel combustion chamber for the purpose of improving fuel combustion is presented The system uses a flask of catalytic solution through which air is bubbled through the solution to absorb a portion of the catalyst and delivered to the combustion air stream of an engine or oil burner of a furnace.

Other inventions including similar technology are found in the following U.S. Patents.

| U.S. Pat. No. | Inventor | Issue Date |
|---|---|---|
| 4,419,967 | A. C. Protacio, et. al | Dec. 13, 1983 |
| 4,410,467 | F. A. Wentworth, Jr. | Oct. 18, 1983 |
| 4,362,130 | A. Robinson | Dec. 7, 1982 |
| 4,090,838 | K. R. Schena | May 23, 1978 |
| 4,016,837 | F. A. Wentworth, Jr. | Apr. 12, 1977 |
| 4,014,637 | K. R. Schena | Mar. 29, 1977 |
| 3,945,366 | R. I. Matthews | Mar. 23, 1976 |
| 3,862,819 | F. A. Wentworth, Jr. | Jan. 28, 1975 |
| 3,450,116 | A. D. Knight, et. al. | June 17, 1969 |

These systems have problems when they are used for delivering a consistently controllable, and sustained rate of catalyst delivery into a combustion area for the purpose of controlling the emissions from the combustion process. No attempts are made to control the humidity of the air entering the system to affect the rate of absorption of an aqueous catalytic solution There is no provision for delivering the air stream under pressure into either the chamber containing the catalytic solution or the positively pressured air stream of a combustion system such as downstream of an engine turbocharger. There is also no mention of a feedback control system to adjust the rate of catalyst delivery to the combustion area depending on the actions occurring in the combustion area.

SUMMARY OF THE INVENTION

Disclosed herein is an emission control system comprised of:

an air pretreatment means for enhancing the ability of air passing therethrough to absorb moisture;

a humidification chamber having an inlet and an outlet, said inlet being attached to said air pretreatment means, said pretreated air passing from said air pretreatment means into said inlet, through said humidification chamber, and being humidified at a consistently controllable rate in its passage through said humidification chamber to and out of said outlet for consistent delivery into the air stream of catalyst.

Disclosed herein is also a method of emission control comprising the steps of:

pretreating air to enhance its ability to absorb moisture; and passing said pretreated air through a humidification chamber to absorb humidity, said humidification chamber being comprised in part of solution and in part of air, said pretreated air being passed through said air.

A BRIEF DESCRIPTION OF THE DRAWING

The aforementioned aspects and features are further elaborated upon in the following description which is made in connection with the accompanying drawings wherein.

DESCRIPTION OF THE INVENTION

Figure 1:
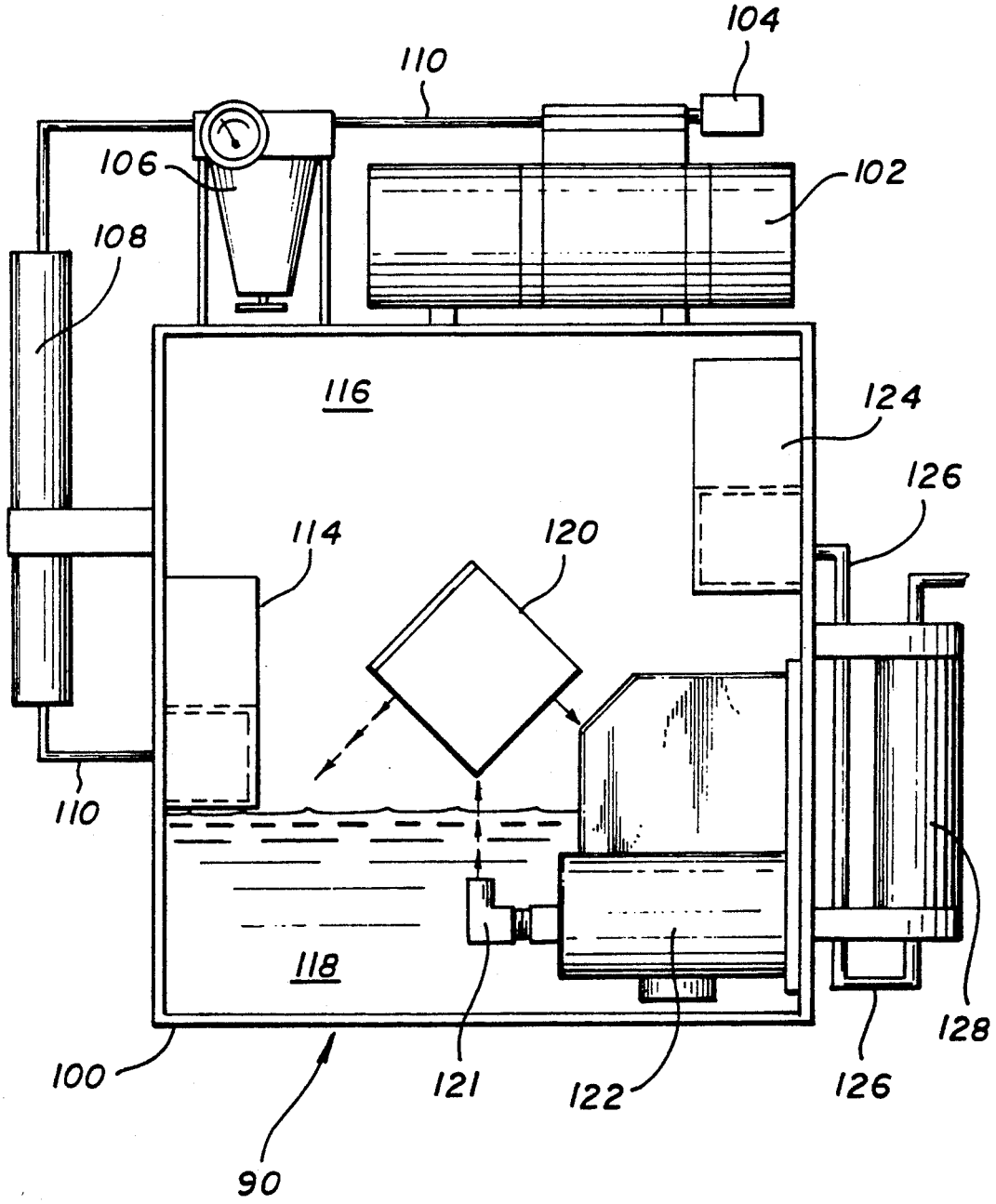
FIG. 1 is a diagrammatic view of a first emission control system in accordance with the invention.

With reference to FIG. 1, there is shown an emission control system 90 constructed in accordance with the invention. It is broadly comprised of a generally square-shaped humidification/ agitation chamber 100 containing air in a vapor space 116 and catalytic solution 118 in the remaining space.

The air which is to absorb a portion of the catalytic solution contained in humidification/agitation chamber 100 passes from filter 104 to air compressor 102 into line 110. In FIG. 1, air compressor 102 is shown connected to the top outside surface of humidification/agitation chamber 100 and interconnected with filter 104. Line 110 extends from filter 104 above air compressor 102 and into air regulator 106. Air regulator 106 is also shown connected at the top humidification/agitation chamber 100 and downstream of air compressor 102. It is well known that if air is pressurized before passing it through a dehumidification means, dehumidification of the air will be achieved and may be done in a more economical fashion since the size of the dehumidification equipment can be reduced. For this reason, the air compressor is included in the present invention to pressurize the air that passes through line 110 into humidification/agitation chamber 100.

Line 110 passes through air regulator 106 which is connected to air compressor 102 by an unshown feedback system to regulate the amount of air compression and air flow. Line 110 extends from air regulator 106 to air dryer and conditioner 108. Air dryer and conditioner 108 is placed downstream of air regulator 106 and in FIG. 1 is shown located at right angles thereto. It is, however, not necessary to locate it at a right angle or any particular angle to the air regulator. It is connected to the side of the outside surface of the humidification-/agitation chamber 100. In air dryer and conditioner 108, the air passing through line 110 is dried to remove as much humidity as possible. By maintaining the dryness of the air passing through line 110, the amount of humidification which occurs in the humidification/agitation chamber 100 can be controlled.

Line 110 passes out of air dryer and conditioner 108 into humidification/agitation chamber 100. Although not shown in FIG. 1, a feedback metering system may be installed to control the amount of humidity in line 110. If the amount of humidity is too high, this information is fed back to the air dryer and conditioner unit 108 so that greater drying of the air occurs. The pressurized and dried air in line 110 then enters humidification/agitation chamber 100 through inlet air baffle 114.

As can be seen in FIG. 1, humidification/agitation chamber 100 is partially filled with a catalytic solution 118. The remaining area of the humidification/agitation chamber, the vapor space 116, is filled with air. Within humidification/agitation chamber 100 is inlet air baffle 114. It is in fluid connection with line 110 as line 110 enters humidification/agitation chamber 100. Inlet air baffle 114 is connected to the inside side wall of the humidification/agitation chamber 100 through which line 110 enters. It is shown in FIG. 1 that the air baffle 114 is located above the surface of the catalytic solution. However, it is conceivable that some amount of the catalytic solution will contact and surround at least the base of the baffle 114. The baffle 114 is present to keep the catalytic solution from entering tube 110. This might occur if the present system is used in an automobile, and movement of the automobile causes the catalytic solution 118 to slosh about the interior of humidification/agitation chamber 100. It is preferable that line 110 be located in its entrance into humidification/agitation chamber 100 above the surface of the catalytic solution.

Connected to an opposing inside wall of the humidification/ agitation chamber 100, is pump 122. As can be seen in FIG. 1, pump 122 is located within and under the surface of catalytic solution 118. Pump 122 is in fluid communication with catalytic solution 118 and connects to spray nozzle 121 which is located under the surface of catalytic solution 118. While nozzle 118 is shown under the surface of catalytic solution 118 it could as well be shown above the surface or only partially submerged in catalytic solution 118. This is because its position is only dependent upon the ability of pump 122 pumping the catalytic solution 118 through nozzle 121 upwardly toward spray diversion bar 120 so that nozzle 121 causes the solution sprayed therethrough to impinge against spray diversion bar 120 which is located thereabove. It is noted that while nozzle 121 must be located within humidification/agitation chamber 100, pump 122 shown located under catalytic solution 118, could instead be only partially submerged in catalytic solution 118 or, in fact, located outside of humidification/agitation chamber 100 while still in fluid connection with nozzle 121 and catalytic solution 118.

Connected above nozzle 121 and spaced from the surface of catalytic solution 118 is spray diversion bar 120. This bar is located in the portion of humidification/agitation chamber 100 in which the air is contained, that is vapor space 116. It is in the form of an angle iron and is connected to a side of the humidification/ agitation chamber 100 although it is in general located preferably centrally in humidification/agitation chamber 100 above nozzle 121. Spray diversion bar 120 is an impingement surface against which the catalytic solution sprayed upwardly by means of nozzle 121 impinges. Because this bar 120 facilitates the dispersal of the catalytic solution about the vapor space 116 for absorption by the incoming air from line 110 it must be located so that the spray from nozzle 121 impinges against it to maximize the dispersal of said spray to facilitate constant absorption of the sprayed fluid in the air passing through humidification/agitation chamber 100. It is not preferable that the location of nozzle 121 and spray diversion bar 120 result in the deflected spray arising from the interrelationship of the two, impact outlet air baffle 124. The discharge pressure of pump 122 is nominally about 4 psig but is controlled by the spray pattern desired to disperse the catalytic solution within the humidification/agitation chamber 100. The inlet line 110 and spray diversion bar 120 should be located so as to maximize the contact of the incoming air with the spray from the spray diversion bar. The positioning of the spray nozzle 121, inlet line 110, and size and location of the spray diversion bar 120 is adjustable to meet the requirement of consistently controllable humidification of the inlet air passing from line 110 into humidification/agitation chamber 100 and out. The position of the spray nozzle below the surface of the catalytic solution 118 will vary during operation of the system as the solution is delivered from the chamber to the combustion area.

Connected above the surface of catalytic solution 118 and opposite of inlet air baffle 114 is outlet air baffle 124. Outlet air baffle 124 is shown in FIG. 1, in the vapor space 116 and connected to the inside wall of humidification/agitation chamber 100. Outlet air baffle 124 is in fluid communication with exit line 126 which passes through the wall of humidification/agitation chamber 116. Humidified air passing from humidification/agitation chamber 100 passes through outlet air baffle 124 to outlet line 126. Again, outlet air baffle 124 is used to prevent the escape of catalytic solution 118 through outlet line 126 as the catalytic solution 118 is sloshed about humidification/agitation chamber 100. It can also be used to separate entrained finely atomized droplets of catalytic solution 118 suspended in the existing air stream.

Outlet line 126 extends from the inside of humidification/agitation chamber 100 to the outside side of humidification/agitation chamber 100 and then to a downstream flow meter 128. Outlet line 126 is intended to be located as far as possible from line 110 with respect to the inside of humidification/agitation chamber 100. This is so that the residence time of the air passing from line 110 through humidification/agitation chamber 100 out outlet line 126 is as long as possible to enhance humidification of this air with the catalytic solution 118. For this reason, outlet line 126 is shown located on a wall opposite that on which line 110 is located and near the inside ceiling of the humidification/agitation chamber 100, well above the surface of catalytic solution 118. Line 110 is located near the surface of catalytic solution 118.

Flow meter 128 contains means to determine the amount of catalyst contained in the air passing through outlet line 126. This meter again, may be connected to feedback controls to adjust the amount of air compression occurring in air compressor 102, the amount of drying occurring in air dryer conditioner 108, and the amount of chemical in the catalytic solution 118. These feedback systems and meters are all used to ensure that a continuous and constant rate of catalyst is being delivered through outlet line 126. Such feedback systems are well known in the art and therefore are not discussed in detail herein.

Flow meter 128 also acts as a restriction in outlet line 126. The effect of this is to increase the pressure of the air from line 110 through humidification/agitation chamber 100 into outlet line 126. This results in increased residence time of the air in humidification/agitation chamber 100 and its consequent humidification with catalytic solution 118. Outlet line 126 continues through flow meter 128 for connection to an air stream.

The air compressor 102 in FIG. 1 represents a component for moving dehumidified air through a chemical delivery system which is the humidification/agitation chamber 100. While an air compressor is shown in FIG. 1, this air compressor could be deleted and instead an external source of compressed air such as connection to a large compression system or bottled compressed air could be used.

The air dryer and conditioner 108 is the air drying component which is used to greatly reduce humidity in the air passing through line 110 so that greater absorption in the humidification/agitation chamber 100 occurs. Typical drying methods are swing bed absorption, refrigeration, desiccants, etc. If refrigeration is used, then FIG. 1 would include downstream of the air dryer and conditioner a heating component. The heating component would heat the air since warm air absorbs more moisture than does cold air. In fact, regardless of whether a refrigeration unit is used, a heating component could be installed between inlet baffle 114 and air conditioner 108 outside of humidification/agitation chamber 100. This heating component could then heat any air sent into the humidification/agitation chamber 100 to increase absorption of that air. The heating element would be connected within the feedback control system so that it would be utilized only when additional humidification appeared necessary. As an alternative, the chemical concentration of the catalyst could be increased by means connected to the feedback system. Again, if the level of chemical concentration is too low, additional chemical could be fed into the catalytic solution 118.

Although a square humidification/agitation chamber 100 is here shown, other shapes may be used. In the foregoing discussion, a sample ½ HP air compressor is used for air compressor 102 and the air is pumped at 10 psig pressure. The air regulator 106 used is a Speedair model 2Z767C. The air dryer and conditioner 108 used is a Silica Gel desiccant. The heating component discussed but not shown is a 25 watt 12 volt resistive heater. Lines 110 and 126 are each 0.25 inches in diameter and made of polypropylene tubing. The humidification/agitation chamber 100 is made of polypropylene plastic but is preferably made of non-reactive metal, plastic, or teflon. All components within the humidification/ agitation chamber 100 are also preferably made of non-reactive metal, plastic, or teflon. The use of some materials creates a plating effect which should be avoided.

As noted above, in the humidification/agitation chamber 100 is the reservoir of aqueous chemical solution known as the catalytic solution 118. Above this solution is a vapor space 116 with sufficient volume to evenly humidify the incoming air fed through line 110. The volume of vapor space is proportional to the desired humidification level of the carrier air and the volume of flow in the carrier air. In the present invention, the humidification/agitation chamber is 0.3 cubic feet in volume with approximately equal dimensions. The amount of catalytic solution preferably contained therein is 0.05 cubic feet. The remaining vapor space then is 0.25 cubic feet. The pump used is a Teel 1P681A and the spray diversion bar is made of 1.5" PVC angle, 3/16 inches thick. The air baffle systems are made of the same material.

The flow metering device 128 may include a control valve, orifice or flow measuring device. Such device would be included to maintain a consistent flow of carrier air through the humidification/agitation chamber 100. The function of this component may be satisfied by the air pressuring component if that component is of the nature to provide a consistent air flow such as a positive displacement compressor. However, this change will decrease the residence time of the air passing through humidification/agitation chamber 100 and thus the humidification of that air. Should this not be desirable, a larger volume vapor space 116 in humidification/agitation chamber may be used to compensate for this change. As noted above, this flow metering device 128 is also useful if modification of the rate of chemical delivery is necessary. By bringing the air catalyst mixture from the humidification/agitation chamber through line 126 into flow meter 128, one can measure the amount of air being fed out of the humidification-/agitation chamber 100. Because of a known quantity of air at a known dryness with a known increase of humidity in the humidification/agitation chamber 100, one is able to obtain a known amount of catalyst out of the system. This is believed to be an advantage of the present catalyst delivery system over presently disclosed techniques.

In operation, air is drawn through filter 104 into air compressor 102, where the pressure of the air is increased. This air continues in line 110 into air regulator 106 for metering and feedback control. From here it continues to air dryer conditioner 108. In air dryer conditioner 108, moisture is removed from the air by the means described above and the air may be further channelled through a heating device via line 110. Metering and feedback devices not shown but well known in the art, continue to monitor the pressure, temperature and humidity level of the air. The air then passes into humidification/agitation chamber 100, through inlet baffle 114 and there into the vapor space 116. While the air from line 110 passes into humidification/agitation chamber 100, pump 122 is operating to pump upwardly toward spray diversion bar 120 the catalytic solution 118. The pump 122 operates at a pressure of about 4 psig. This causes the catalytic solution 118 to be carried up against spray diversion bar 120 and to be dispersed in a spray so that the catalytic solution can be adequately absorbed by the air passing through humidification/agitation chamber 100. The effect is an absorption/humidifying effect and the constant and even absorption of the catalyst occurs due to the continuing presence of dry, pressurized and possibly heated air being fed into the humidification/agitation chamber 100 by line 110. The air which has absorbed with the aqueous catalyst solution, then exits through outlet baffle 124 into line 126 by the pressure created by air compressor 102. This exit may be assisted by an air flow inducing device on outlet line 126 to further enhance delivery of the air to its ultimate destination.

With this system, a constant humidification rate is obtained. The air laden with chemical may be passed through outlet line 126 into the airstream under pressure. This is a system delivering a sustained, consistently controllable flow of aqueous chemical solutions into the combustion zone of a fossil fuel device.

Figure 2:
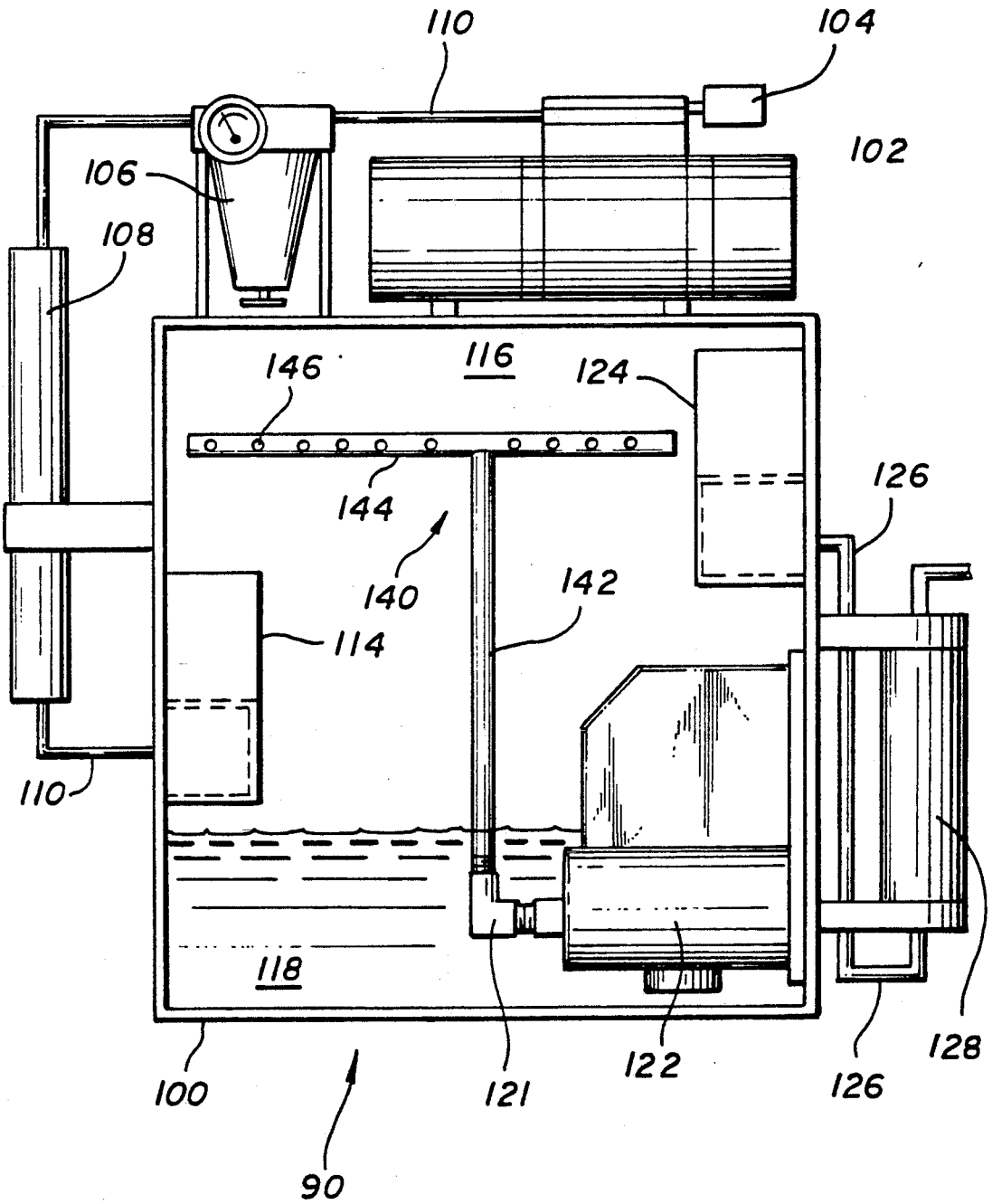
FIG. 2 is a second embodiment of the emission control system of the invention.

With reference to FIG. 2 there is shown further embodiment of the present invention. All of the components described with respect to FIG. 1 are the same in FIG. 2 with the exception of spray diversion bar 120. Instead of using spray diversion bar 120, sprinkler 140 is used.

As can be seen from FIG. 2, sprinkler 140 is "T" shaped. The lower vertical portion 142 connects directly to nozzle 121 which lies within catalytic solution 118. The horizontal portion 144 of sprinkler 140 is in fluid communication with the vertical portion and extends ¾ of the vertical distance above the surface of the catalytic solution to the top of humidification/agitation chamber 100, and in fact, above the point of inlet of line 110 and the top of inlet baffle 114. In sprinkler 140, along the horizontal portion 144 are a plurality of spray nozzles 146. Sprinkler 140 is preferably centrally located in humidification/agitation chamber 100. In this embodiment, pump 122 pumps the catalytic solution 118 through nozzle 121 into vertical bar 142 and out of spray nozzles 146. This facilitates humidification of the air passing through the humidification/agitation chamber 100. Here as in FIG. 1, pump 122 may instead be located outside of humidification/agitation chamber 100 and in fluid communication with nozzle 121 and catalytic solution.

Figure 3:
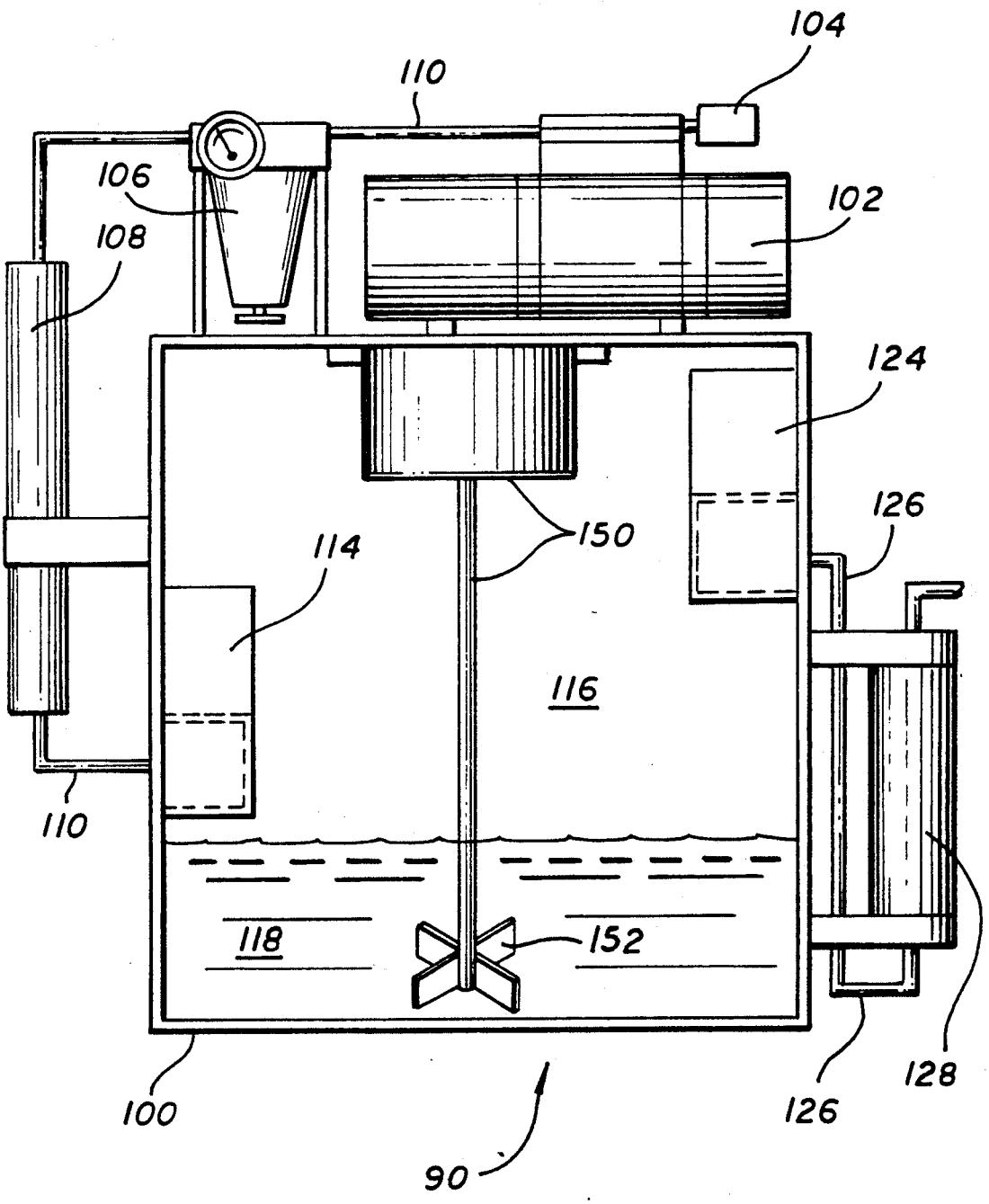
FIG. 3 is a third embodiment of the emission control system of the invention.

In the third embodiment shown herein in FIG. 3, the parts are again identical with those shown in FIG. 1 with the exception that pump 122 and its connecting nozzle 121 as well as spray diversion bar 120 are eliminated. Instead, motor and impeller shaft 150 extend from about the center of the ceiling of humidification-/agitation chamber 100 toward the bottom of humidification/agitation chamber 100. At the bottommost end of the shaft 150 near the bottom of humidification/agitation chamber 100 are impeller blades 152. The propeller 150, 152 rotates to mix and agitate the catalytic solution 118 to facilitate humidification of the air passing through vapor space 116. The optimum speed of the propeller is about 1750 rpm. Faster speeds can develop a layer of foam on the surface of catalytic solution 118 which may inhibit humidification of the incoming air.

Figure 4:
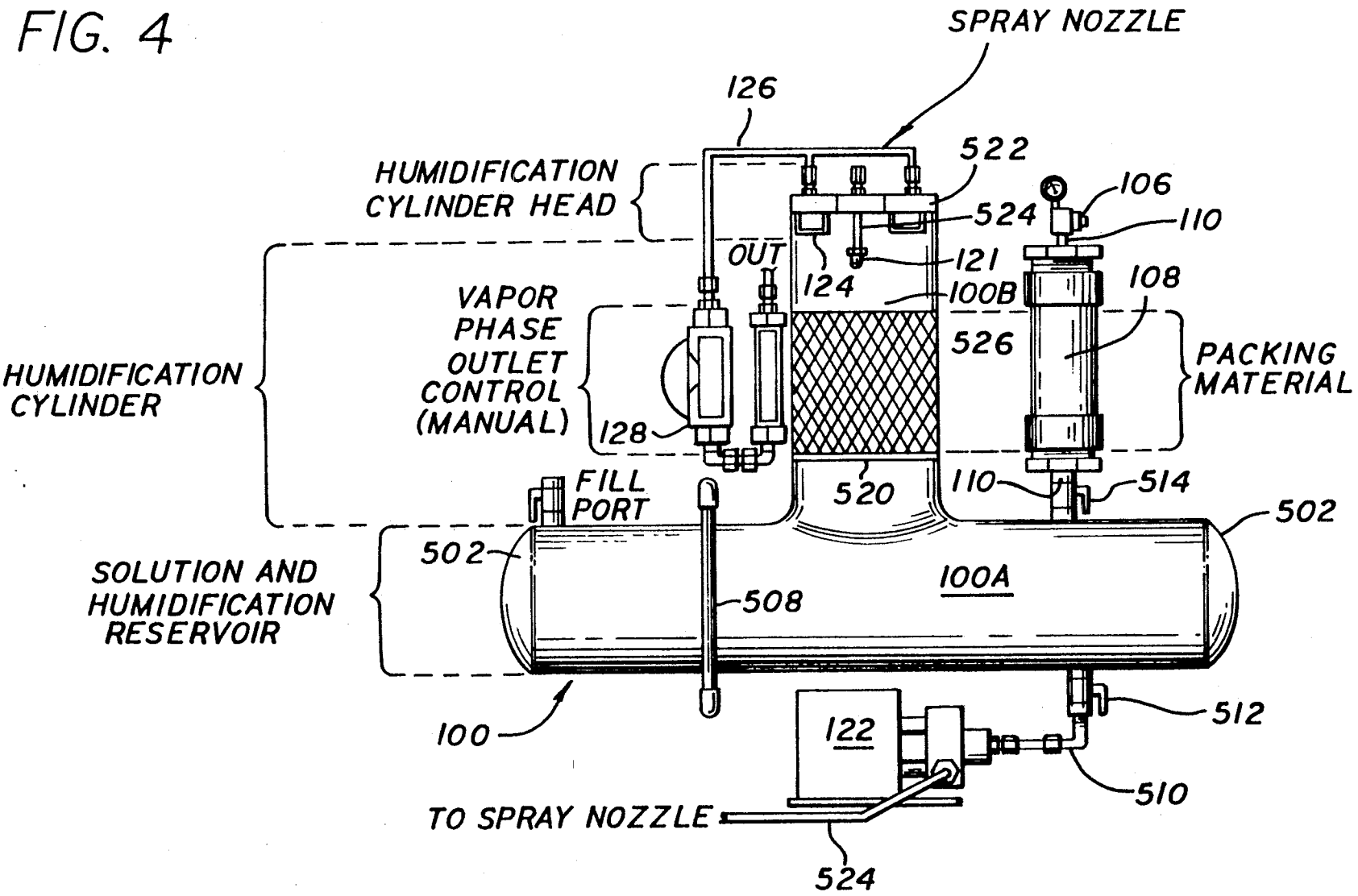
FIG. 4 is a fourth embodiment of the emission control system of the invention.

The embodiment shown in FIG. 4, while sharing a common theory of operation with the previous embodiments, is quite different in shape from those embodiments. It is noted however, that the first embodiment shown in FIG. 1 would require only slight modification to accomplish the same result as the embodiment of FIG. 4 offers.

FIG. 4 shows an upside down "T" shaped humidification/agitation chamber 100. The horizonal bar of the "T" forms the bottom 100*a* of the chamber in which catalytic solution 118 is contained. The vertical portion of the "T" forms the top 100*b* of the chamber in which the majority of the vapor space 116 is. Bottom 100*a* is of a first diameter and is sealed at its two opposing sealed ends 502. Preferably centrally of bottom 100*a* extends top 100*b* of a second diameter.

Extending from the uppermost portion of the left hand sealed end 502 is fill port 506. Fill port 506 is in fluid communication with the interior of humidification/agitation chamber 100 and particularly bottom 100*a*. This port may be connected to a catalytic solution reservoir which is not shown but which feeds the catalytic solution 118 into humidification/agitation chamber 100. On the other hand, fill port 506 may merely be a closable port for the intermittent addition of catalytic solution 118 as needed. If fill port 506 is connected to a reservoir for automatic replenishment of catalytic solution 118, such connection will include a feedback system which measures the level of the catalytic solution 118 in bottom 100*a* and triggers replenishment of the solution through fill port 506. Feedback systems of this nature are well known to those skilled in the art and therefore not described in detail herein.

Extending outside of but in fluid communication with the interior of bottom 100*a*, is level gauge 508. This gauge measures the level of catalytic solution 118 in bottom 100*a* and provides this information to the viewer of the gauge 508. If the automatic feedback system described above is used, gauge 508 may interrelate therewith in a manner well known in the art. Otherwise, gauge 508 may merely be used to advise the user thereof when catalytic solution 118 needs to be added to bottom 100*a* through fill port 506.

Connected outside of humidification/agitation chamber 100 but in fluid communication therewith is pump 122. Line 510 extends from and connects pump 122 to fluid valve 512 which is in fluid communication with the interior of humidification/agitation chamber 100 so that catalytic solution 118 contained within humidification/agitation chamber 100 may be pumped out through fluid valve 512 into pump 122. Fluid valve 512 is shown connected to the base of bottom 100*a* at the end opposite the connection of fill port 506.

Connected generally above fluid valve 512 and necessarily above the catalytic solution 118 is line 110. Line 110 is in fluid communication with humidification/agitation chamber 100 and in FIG. 4 is shown to be in fluid communication with bottom 100*a* of humidification-/agitation chamber 100. Line 110 extends into bottom 100*a* by means of air valve 514. Line 110, as in the previous figures, passes through and is in fluid communication with air drier and conditioner 108 which lies outside of humidification/agitation chamber 100 and in FIG. 4 above bottom 100*a* and to the right side of top 100*b*. Above air drier and conditioner 108 is air regulator 106. The two are connected by line 110. Line 110 extends out of air regulator 106 to air compressor 102 and filter 104 as described with respect to the previous figures.

The vertical portion of the T-shaped humidification-/agitation chamber 100 which is top 100*b*, extends upwardly from the horizontal portion which is bottom 100*a*. At the top end of top 100*b*, opposite its connection to bottom 100*a*, is end cap 522 which seals top 100*b*. Extending preferably centrally from end cap 522 into top 100*b* and coaxial therewith, is nozzle 121. Nozzle 121 connects through line 524 to pump 122. As can be seen in FIG. 4, line 524 extends from pump 122, outside of humidification/agitation chamber 100 to and through end cap 522 to nozzle 121. Fluid pumped through fluid valve 512 into line 510 and then pump 122 passes into line 524 to nozzle 121 to be sprayed into top 100*b*.

On opposite sides of nozzle 121 in end cap 522, are outlet air baffles 124. It is noted that nozzle 121 extends below the ultimate end of air baffles 124 so that fluid spraying from nozzle 121 does not enter outlet air baffles 124, but is directed downwardly and outwardly into top 100*b*. Outlet air baffles 124 are seen to extend into top 100*b* at one end, and to be in fluid connection with line 126 which extends outside of humidification/agitation chamber 100 at another end. Line 126 is seen to fork above end cap 522 to accommodate the connection to both outlet air baffles 124. Line 126, as in the previous figures, extends from the outlet air baffles 124, outside of humidification/agitation chamber 100 to flow meter 128. Through flow meter 128, line 126 extends as previously described. In FIG. 4, flow meter 128 is shown located opposite of air regulator 108 on the left side of tube 520 near fill port 506.

In top 100*b*, at about the junction point of top 100*b* and bottom. 100*a* is seen support grate 520 which holds thereabove packing 526. Support grate 520 is welded, melted, bonded or otherwise connected inside of humidification agitation chamber 100 or is formed therewith. Packing 526 lies on grate 520 and extends upwardly toward nozzle 121 filling a portion of top 100*b*. Thus in the interior of humidification/agitation chamber 100 is catalytic solution 118 in bottom 100*a*, vapor space 116 above catalytic solution 118, and packing 526 in vapor space 116 spaced from catalytic solution 118 and in top 100*b*. Packing 526 is also spaced from nozzle 121 and baffles 124.

In FIG. 4, humidification/agitation chamber 100 is again made of a non reactive material and in this instance is made of 2 inch Schedule 80 polyvinyl chloride pipe. Grate 520 is made of the same material or of any non reactive material. The packing material is comprised of pieces of ¼ inch diameter polypropylene tubing ¼ inch long with a wall thickness of 0.040 inches. It is packed to a depth of nine inches and is spaced approximately ½ to 2 inches from nozzle 121. The packing material allows the passage of air and water therethrough and is nonabsorbent. The diameter of top 100*b* is 2 inches and its length is 13 inches. The length of bottom 100*a* is 14 inches and its diameter is approximately 4 inches. Available brands and measurements of the other elements of FIG. 4 are either readily known to those skilled in the art or are the same as described with respect to the previous figures.

In operation, catalytic solution 118 is brought into bottom 100*a* by pouring it through fill port 506. Bottom 100*a* is only partially filled to enable vapor space 116 to begin above the catalytic solution 118 in bottom 100*a* and extend into and to the top of top 100*b*. Preferably, bottom 100*a* is filled no further than two thirds full with catalytic solution 118. This solution is pumped through pump 122 into nozzle 121 where it is sprayed out onto packing 526 and drips back into bottom 100*a*. The spray is emitted from nozzle 121 at a low pressure with a full cone spray pattern whose diameter is preferably equal to the diameter of top 100*b*. This facilitates even distribution of catalytic solution 118 over packing 526. As the foregoing process is ongoing, air is pumped through line 110 into vapor space 116 and upwardly through grate 520 and packing 526. As this air passes through packing 526, it absorbs the aqueous solution on and surrounding packing 526 and exits out of outlet air baffles 124.

As can be readily appreciated, the embodiment in FIG. 4, makes use of moistened packing to humidify the air which passes from line 110 to line 126. It is important that the shape of the elements used to make up packing 526 be selected to meet the amount of surface area needed to facilitate absorption of the moisture by the air. Thus the use of hollow tubing offers a different surface area than the use of solid beads. Other packing known to those skilled in the art could be used bearing in mind the foregoing described purposes and functions.

In the present embodiment, the air pressure pumped through line 110 into vapor space 116 is 10 psig, the spray pressure from nozzle 121 does not exceed 4 psig, and the spray pattern has a fanout equal to the diameter of top 100*b*.

To attend to the mixing of the treated air with the catalytic solution, agitation of catalytic solution 118 by means of ultrasound frequencies or heat is contemplated in addition to the foregoing described processes. These methods too would disperse the aqueous solution into the vapor space 116.

As noted earlier, all elements contained in humidification/agitation chamber 100 should be of non-reactive metal, plastic or teflon.

Baffles or other optional equipment can be added to increase the residence time of the carrier air within the vapor space 116 to allow for consistently controllable humidification of the carrier air with the aqueous solution 118. Baffles may also be necessary depending on the selection of humidification method.

While the embodiments disclosed herein place the means for pressurizing the air or subjecting the air to vacuum pressure in an area preceding the air's entrance into air regulator 106 and air drier and conditioner 108, such means could as well be placed elsewhere in the system such as at the end of the system or preceding humidification/agitation chamber 100.

While not shown in the embodiments herein, feedback systems are contemplated and preferred for the greatest amount of consistency, controllability, and sustainability of emission control. Such feedback systems are well known in the art. The feedback systems contemplated and discussed herein measure changes in the system and cause adjustment in at least one of a number of operating parameters in the system to respond to these changes. These operating parameters are:

1) the pressure of the air as it passes through the system and any part thereof;
2) the temperature of the air as it passes through the system and any part thereof;
3) the activity of the dissemination devices of catalytic solution 118 in humidification/agitation chamber 100;
4) the amount of catalytic solution 100 in humidification/agitation chamber 100;
5) the amount of catalytic solution 118 to vapor space 116 in humidification/agitation chamber 100;
6) the flow rate of air through the entire system or any part thereof;
7) the chemical concentration of the catalytic solution held in humidification/agitation chamber 100;
8) the humidity of the air as it leaves the pretreatment portion of the system 102, 104, 106, 108 to enter humidification/ agitation chamber 100, and as it leaves humidification/agitation chamber 100.

Feedback systems which measure these items and adjust the system accordingly are included in the present invention to make the present invention more automatic in operation so that it produces more consistent, sustained, controllable (automatically and manually) results.

Also contemplated are feedback systems which measure external variables to the system and adjust at least one of the operating parameters listed above in response to changes in the monitored external variable. The use of these feedback systems are to enhance the control of emissions from fossil fuel combustion devices by adjusting the rate of delivery of aqueous solution containing catalytic chemicals to the combustion air stream.

The external variables considered as potential feedback sources to the emission control device include the set of variables associated with the incoming air stream such as its pressure, temperature, or humidity, the set of variables associated with the measured emissions from the exhaust of the fossil fuel combustion device such as the concentration of specific chemical in the exhaust, and the set of variables associated with the operating parameters of the combustion device such as speed of rotation, load, manifold vacuum pressure, fuel consumption, temperature, fuel pressure, turbocharger discharge pressure, turbocharger speed.

In all of the foregoing figures, line 110 is shown at least just above the surface of the catalytic solution 118 and generally in the range of ¼" to 2" above the maximum height of the solution. The idea is to bring the air from line 110 into the humidification/agitation chamber 100 above the surface of catalytic solution 118 and delay its passage out of the humidification/agitation chamber 100 until consistently controllable humidification of the air is accomplished. With this goal in mind, the incoming air has been pretreated and outlet line 126 is shown in all embodiments to be located near or at the top of humidification/agitation chamber 100 and generally within the range of ¼" to 2" below the ceiling the humidification/agitation chamber 100. In this way, the air is processed for absorption and is forced to take a path through humidification/agitation chamber 100 which will provide it with adequate time to consistently absorb moisture in the chamber.

It is noted that air drier conditioner 108 in each embodiment may be filled with water absorbing desiccant.

In all embodiments disclosed herein, the inlet carrier air carried in line 110 and treated by air dryer and conditioner 108 and air compressor 102 enters the humidification/agitation chamber 100. It enters this chamber above the surface of the liquid catalyst solution 118 and flows across the vapor space 116 and into outlet air baffles 124 while becoming humidified with chemical laden water vapor. The humidified air exits through the outlet air baffle 124 into line 126 and through flow meter 128. The embodiments differ merely in the means of humidifying the air as it passes through humidification/agitation chamber 100. However, they are the same in their ability to delivery in a consistently controllable manner catalyst to the air stream.

Herein, certain descriptive terms are used repeatedly. These are consistently controllable, and sustained. By the term consistently controllable is meant that the amount of catalytic solution 118 that is fed into the combustion air stream regardless of incoming humidity, pressure or temperature of air is consistently controllable to enable the delivery of a consistent amount of catalyst to the air stream. This consistency in part is due to the control and pretreatment of the air which is passed into humidification/agitation chamber 100. If this air is kept at a constant rate of absorbability it will be humidified with the same or required amount of solution during operation of the system to enable the controllability of emissions in the system. Thus if more catalytic solution needs to be delivered to the air stream, this system adjusts for this need. This consistent controllability of the results desired is enhanced by the use of feedback means which facilitates automatic and manual adjustment of the system.

By the term sustained is meant that during use of the system, the consistency of the result will at best not vary at all, and at worst only vary slightly but less than the prior art devices. Any significant variation would be detected by the above-discussed feedback systems and appropriate changes in the system would be automatically made.

By the term controllable is meant that the system has adjustable parameters of operation that are met by automatic and manual adjustment of the system, such adjustments being enhanced by the use of feedback controls. With this controllability, the amount of catalyst delivered to the combustion air stream of a fossil fuel device is consistently controllable.

It is understood that the concept disclosed herein is the pumping into humidification/agitation chamber 100 of air that is highly absorbent. This air is pumped into the vapor space 116 of humidification/agitation chamber 100 to be mixed with a catalytic solution 118 in any reasonable means so that the air becomes humidified as it passes out of outlet air baffle(s) 124 into line 126. The presently disclosed embodiments deliver a consistently controllable, and sustained amount of catalyst into a combustion area. This consistency, substainability and controllability is enhanced by the use of feedback systems.

The present invention is claimed as follows:

1. A method of emission control through a system, said method comprising the steps of:

pretreating air to enhance its ability to absorb moisture; passing said pretreated air through a humidification chamber to absorb humidity, said humidification chamber being comprised of solution in one part and of air in a second part, said pretreated air being passed through said air;

measuring the activities of said system through feedback means to ensure that the method provides consistently controllable results, said feedback means measuring changes in the system and external to the system, said measurements being compared with a preset requirement of delivering a controllable amount of solution to the combustion air stream and in accordance with the results of this comparison adjusting at least one of the following operating parameters in the system;

1) the pressure of the air as it passes through the system;
2) the temperature of the air as it passes through the system;
3) the pressure of the air as it passes through any single part of the system;
5) the amount of solution in the chamber;
6) the concentration of chemicals in the solution;
7) the flow rate of air through the system:
8) the flow rate of air through any one part of the system;
9) the humidity of the air as it leaves the system;
10) the humidity of the air as it leaves the areas wherein it is pretreated and enters the chamber;
11) the activity of the dissemination devices of the solution in the chamber.

2. The method of claim 1 wherein said solution is agitated to disseminate it in the part of said chamber having air so that said solution is more readily absorbed by the pretreated air passing through said air in said chamber.

3. The method of claim 1 wherein said pretreating of said air comprises exposing said air to at least one of the following: 1) pressurization; 2) vacuum pressure; 3) temperature change; 4) dehumidification.

4. The method of claim 2 wherein said agitation of said solution involves the use of any one of the following: 1) ultrasound frequencies; 2) heat; 3) spray; 4) mixing; 5) column absorption.

5. A method of emission control comprising the steps of:

pretreating air to enhance it ability to absorb moisture, said pretreating step comprising at least dehumidifying said air;

passing said pretreated air through a humidification chamber to absorb humidity.

6. The method of claim 3 wherein said vacuum is generated by one of 1) a fossil fuel combustion device; 2) an auxiliary vacuum generator.

7. An emission control system comprised of:

an air pretreatment means for enhancing the ability of air passing therethrough to absorb moisture, said air pretreatment means at least dehumidifying the air passing therethrough;

a humidification chamber having an inlet and an outlet, said inlet being attached to said air pretreatment means, said pretreated air passing from said air pretreatment means into said inlet and out of said outlet.

8. The emission control system of claim 7 wherein in said air pretreatment means the air passing therethrough is pressurized.

9. The emission control system of claim 7 wherein in said air pretreatment means the air passing therethrough is pressurized and dehumidified to enhance its ability to absorb moisture.

10. The emission control system of claim 7 wherein in said air pretreatment means the air passing therethrough is pressurized and subject to vacuum pressure.

11. The emission control system of claim 7 wherein in said air pretreatment means the air passing therethrough is subject to at least one of the following:

1) pressurization, 2) heat, 3) vacuum pressure.

12. The emission control system of claim 7 wherein said humidification chamber contains in one part a solution and in another part air, said air being adjacent to said solution, said inlet and said outlet being in fluid communication with said part containing said air, said system also comprising solution dissemination means, said dissemination means acting to disseminate some of said solution into said air while said pretreated air is passed through said inlet into said air and out of said outlet, said dissemination means facilitating the consistently controllable absorption of said solution by said pretreated air.

13. The emission control system of claim 9 wherein said humidification chamber contains in one part a solution and in another part air, said air being located adjacent to said solution, said inlet and said outlet being in fluid communication with said air, said system also comprising solution dissemination means, and dissemination means acting to disseminate some of said solution into said air while said pretreated air is passed through said inlet into said air and out of said outlet, said dissemination means facilitating the consistently controllable absorption of solution by said pretreated air.

14. The emission control system of claim 12 wherein said dissemination means is comprised of a nozzle connected to a pump and an impingement surface, said pump being in fluid communication with said solution in said chamber, said nozzle being located in said chamber, said impingement surface being located in said chamber between said inlet and said outlet and in said part containing said air, said pump acting to pump said solution through said nozzle to be sprayed against said impingement surface thereby disseminating said solution in said air so that said pretreated air passing through said chamber may be humidified.

15. The emission control system of claim 12 wherein said dissemination means is comprised of a spraying means connected to a pump, said pump being in fluid communication with said solution in said chamber, said spraying means being located in said chamber, said pump acting to pump said solution through said spraying means and to be sprayed into said part containing said air thereby disseminating said solution in said air so that said pretreated air passing through said chamber may be humidified.

16. The emission control system of claim 12 wherein said dissemination means is comprised of a propeller within said solution, said propeller rotating in said solution to cause said solution to be agitated and to splash into said air, said propeller thereby disseminating said solution in said air so that said pretreated air passing through said chamber may be humidified.

17. The emission control system of claim 12 wherein said dissemination means is comprised of a spraying means connected to a pump and a packing located in said part containing said air, said pump being in fluid communication with said solution in said chamber, said spraying means being located in said chamber, said pump acting to pump said solution through said spraying means to be sprayed onto and through said packing, said packing being located between said inlet and outlet so that said pretreated air must pass through said packing to reach said outlet.

18. The apparatus of claim 7 wherein:

said pretreatement means is comprised of pressurizing and dehumidifying means;

said humidification chamber is of an upside down T shape with the horizontal portion thereof being partially filled with a solution and the remaining area in said horizontal portion serving as vapor space, the vertical part of said T containing a packing, said inlet and said outlet being in fluid communication with said vapor space; and wherein the system further comprises a spray nozzle located in said vertical part of said T above said packing and in fluid communication with said solution, such that said spray nozzle sprays solution onto said packing while pretreated air from said pretreatment means passes through said inlet into said vapor space and up through said packing toward said nozzle and out of said outlet.

19. The emission control system of claim 7 further comprising feedback means associated with said pretreatment means, said feedback means measuring the level of humidity in the air passing into said pretreatment means and adjusting said pretreatment means so that said air processed in said pretreatment means and channeled to said humidification chamber is absorbent of humidity in said chamber.

20. The system of claim 18 further comprising humidification feedback means associated with said pretreatment means, said humidification feedback means measuring the moisture of the air coming into said pretreatment means and adjusting the heat and pressure used in said pretreatment means accordingly.

21. The emission control system of claim 7 further comprising humidification feedback means associated with said pretreatment means, said humidification feedback means measuring the moisture of the air coming into said pretreatment means and adjusting the heat and pressure used in said pretreatment means accordingly.

22. The emission control system of claim 12 further comprising humidification feedback means associated with said pretreatment means, said humidification feedback means measuring the moisture of the air coming into said pretreatment means and adjusting the heat and pressure used in said pretreatment means accordingly.

23. The emission control system of claim 12 further comprising feedback means associated with the consistently controllable humidification of said pretreated air passing through said chamber wherein if the amount of humidification of said pretreated air with said solution varies outside of a certain range at least one of the following changes is effected by said feedback system to maintain the consistently controllable humidification of said pretreated air; (1) the concentration of said solution is altered; (2) the flow rate of air into the chamber is altered; (3) the dehumidification of the air prior to entrance into the chamber is altered; (4) the pressurization of the air prior to entrance into the chamber is altered.

24. The emission control system of claim 18 further comprising feedback means associated with the consistently controllable humidification of said pretreated air passing through said chamber wherein if the amount of humidification of said pretreated air with said solution varies outside of a certain range at least one of the following changes is effected by said feedback system to maintain the consistently controllable humidification of said pretreated air; (1) the concentration of said solution is altered; (2) the flow rate of air into the chamber is altered; (3) the dehumidification of the air prior to entrance into the chamber may be altered; (4) the pressurization of the air prior to entrance into the chamber is altered.

25. An emission control system for use with fossil fuel combustion devices comprising:

an air pretreatment means for enhancing the ability of air passing therethrough to absorb moisture;

a humidification chamber having an inlet and an outlet, said inlet being attached to said air pretreatment means, said pretreated air passing from said air pretreatment means into said inlet and through said humidification chamber, said pretreated air being humidified at a consistently controllable rate in its passage through said humidification chamber to and out of said outlet.

26. A method of introducing a sustainable, and consistently controllable amount of aqueous solution containing catalytic chemicals into the combustion air stream of fossil-fuel combustion devices for the purpose of controlling the emissions from said fossil-fuel combustion devices, said method comprising the steps of:

pretreating air to make it highly moisture absorbent; and passing said pretreated air through a humidification chamber to absorb humidity therein at a consistently controllable rate.

27. The method of claim 26 further comprising the step of obtaining feedback information of the emissions obtained with the use of said steps of pretreating and passing, and using said feedback information to alter said steps of pretreating and passing wherein additional control of the amount of aqueous solution containing catalytic chemicals contained in said humidification chamber is delivered into the combustion air stream of said fossil fuel combustion device.

28. A method of emission control comprising the steps of: pretreating at least through a process of dehumidification air to enhance said air's ability to absorb moisture; and passing said pretreated air through a humidification chamber to absorb humidity.

29. A method of emission control comprising the steps of: pretreating at least through a process of dehumidification air to enhance the ability of said air to absorb moisture; and passing said pretreated air through a humidification chamber to absorb humidity, said humidification chamber being comprised in part of solution and in part of air, said pretreated air being passed through said air.

30. An emission control system comprised of: an air pretreatment means for enhancing the ability of air passing therethrough to absorb moisture, said air pretreatment means acting at least to dehumidify said air passing therethrough; a humidification chamber having an inlet and an outlet, said inlet being attached to said air pretreatment means, said pretreated air passing from said air pretreatment means into said inlet and out of said outlet.

31. An emission control system for use with fossil fuel combustion devices comprising:

an air pretreatment means for enhancing the ability of air passing therethrough to absorb moisture, said air pretreatment means at least dehumidifying said air;

a humidification chamber having an inlet and an outlet, said inlet being attached to said air pretreatment means, said pretreated air passing from said air pretreatment means into said inlet and through said humidification chamber, said pretreated air being humidified at a consistently controllable rate in its passage through said humidification chamber to and out of said outlet.

32. A method of introducing a sustainable and consistently controllable amount of aqueous solution containing catalytic chemicals into the combustion air stream of fossil-fuel combustion devices for the purpose of controlling the emissions from said fossil-fuel combustion devices, said method comprising the steps of:

pretreating air at least by dehumidifying said air to make it highly moisture absorbent; and passing said pretreated air through a humidification chamber so that said air absorbs humidity at a consistently controllable rate.

* * * * *